United States Patent [19]

Jaulmes

[11] 3,999,522

[45] Dec. 28, 1976

[54] INTAKE CONTROL SYSTEM FOR INTERNAL COMBUSTION ENGINE

[75] Inventor: Eric Jaulmes, Paris, France

[73] Assignee: Ateliers de la Motobecane, Pantin, France

[22] Filed: Jan. 24, 1975

[21] Appl. No.: 543,943

[30] Foreign Application Priority Data

Feb. 8, 1974 France ..... 74.4250

[52] U.S. Cl. ..... 123/52 M; 137/625; 138/46; 251/193; 251/326; 261/41 C

[51] Int. Cl.[2] ..... F02M 35/10

[58] Field of Search ..... 123/98, 73 A, 188 M, 123/52 M, 52 MV, 74 D, 59 DC; 251/326, 186, 176, 193, 174; 137/625, 18; 138/45, 46; 261/23 A, 41 C, 65

[56] References Cited

UNITED STATES PATENTS

| | | | |
|---|---|---|---|
| 2,086,292 | 7/1937 | Chanard | 261/41 C |
| 2,325,546 | 7/1943 | Regar | 261/41 C |
| 3,572,656 | 3/1971 | Oshima | 261/65 X |
| 3,713,630 | 1/1973 | Laprade et al. | 261/23 A |

*Primary Examiner*—Charles J. Myhre
*Assistant Examiner*—William C. Anderson
*Attorney, Agent, or Firm*—Browdy and Neimark

[57] ABSTRACT

An intake system for an internal combustion engine has been developed to include a translationally movable throttle to cause cross-sectional passage of the intake manifold of the engine cylinders to vary. This throttle utilizes a substantially rigid plate which is pierced with orifices adapted to be connected with each of the intakes corresponding to the various engine cylinders. A movable blade is provided with apertures corresponding in number and spacing to the orifices which contacts with a control and guide means so that the blade is allowed to move parallel to the plate from a running position in which the apertures of the blade are substantially opposite the orifices of the plate to an idle position in which at least the majority of the orifices of the plate are obturated by the blades.

13 Claims, 6 Drawing Figures

INTAKE CONTROL SYSTEM FOR INTERNAL COMBUSTION ENGINE

FIELD OF THE INVENTION

The present invention relates to an intake control system for an internal combustion engine, with a particular utility in a two-cycle multicylinder engine.

BACKGROUND OF THE INVENTION

In addition to the butterfly valve system widely used in carburators, intake control systems are also known which include a translationally displaceable throttle plate. However, known systems of the latter type are of delicate and complicated design and are difficult to service.

SUMMARY OF THE INVENTION

The system of the invention can operate either with a carburator intake to control the volume of air-fuel mixture entering the cylinders, or, preferably, with fuel injection to control the volume of air admitted, for example, into the sealed crankcase of a two-cycle engine.

According to the invention, the intake control system for an internal combustion engine, in particular a two-cycle multicylinder engine, which includes a movable throttle plate designed to cause the passage cross-section of the engine cylinders' intake manifolds to vary, is characterized by including the following features: a substantially rigid plate pierced with orifices designed to be connected respectively with each of the intakes corresponding to the various engine cylinders; a movable blade, with a number of apertures equal to that of the orifices in the plate, the spacing between these apertures being equal to the spacing between these orifices; control means and guiding means of the blade, said means designed for the blade to move parallel to the plate, and to pass from a running position in which the apertures in the blade are substantially opposite the orifices in the plate to an idle position wherein the orifices of the plate (or at least a majority) are obturated by the blade; and elastic elements which are arranged to apply, in a gastight manner, the solid parts of the blade to the solid parts of the plate.

According to an important characteristic of the invention, the thickness of the blade and the mechanical characteristics of the material composing it are chosen such that, under the action of the elastic elements, the blade takes on the shape of the surface of the plate to which it is applied and also resists the force due to the negative pressure prevailing in the intake manifold during operation.

Thus, due to a judicious choice of the flexibility of the movable blade, problems of tightness between the movable blade and the plate are resolved very simply, without entailing costly machining of the corresponding faces of the plate and the blade. Moreover, this system has great operating reliability as the movable blade is capable of taking on the shape of the corresponding face of the plate if the latter bends slightly due to forces exerted during assembly or operation.

According to a preferred embodiment of the invention, the movable blade is mounted in a substantially dust-sealed box one side of which is constituted by the plate and the other side by a lid with a peripheral flange applied to the plate. Thus, only one face of this flange need be machined.

The elastic components can be constituted by a leaf spring or by a series of coil springs. Moreover, the apertures in the blade each communicate with a slot of small cross section which is opposite one orifice of the plate in the idle position such as to permit fine adjustment of the engine idle speed.

According to an advantageous embodiment of the invention, the control means of the movable blade includes a manual activating means and an elastic return means arranged such that the activating and return forces are co-linear and substantially parallel to the blade such as to avoid any flexional torque on the blade which could cause the blade to bend and thus destroy its tightness.

It is accordingly an object of the present invention to overcome the defects of the prior art as mentioned above.

Another object of the present invention is to produce an intake control system with a displaceable throttle plate.

A further object of the present invention is to produce an intake control system which is both rugged and inexpensive.

Still another object of the present invention is to produce an intake control system in which a movable blade is capable of taking on the shape of a corresponding face of the plate.

Other characteristics and advantages of the invention will become apparent from the detailed description hereinbelow.

BRIEF DESCRIPTION OF THE DRAWING

A preferred embodiment of the invention is shown in the attached drawings provided as non-limitative examples.

DETAILED DESCRIPTION OF THE PREFERRED EMBODIMENT

Figure 1:
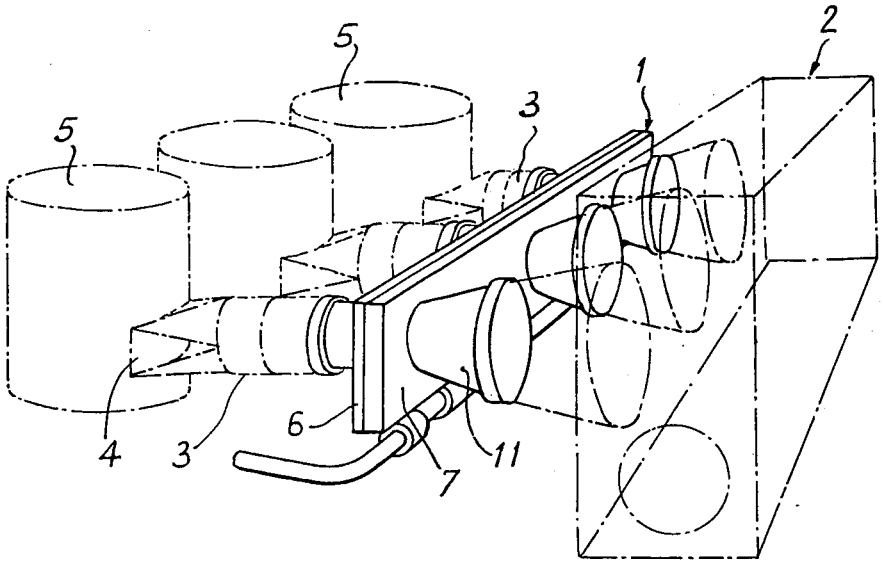
FIG. 1 is a schematic perspective view showing a control system according to the invention cooperating with a multi-cylinder engine.

FIG. 1 schematically shows an intake control system 1 according to the invention for a multicylinder internal combustion engine which uses, for example a two-cycle engine.

In the embodiment to be described, the engine is assumed to be supplied by a fuel injection system such that system 1 is designed to control the volume of air admitted into the engine.

This system is connected on one side to an assembly of silencers and air filters 2. On the other side it is connected by flexible pipes 3 to the air intakes 4 each corresponding to each of cylinders 5.

Figures 2A, 3A, 5A:
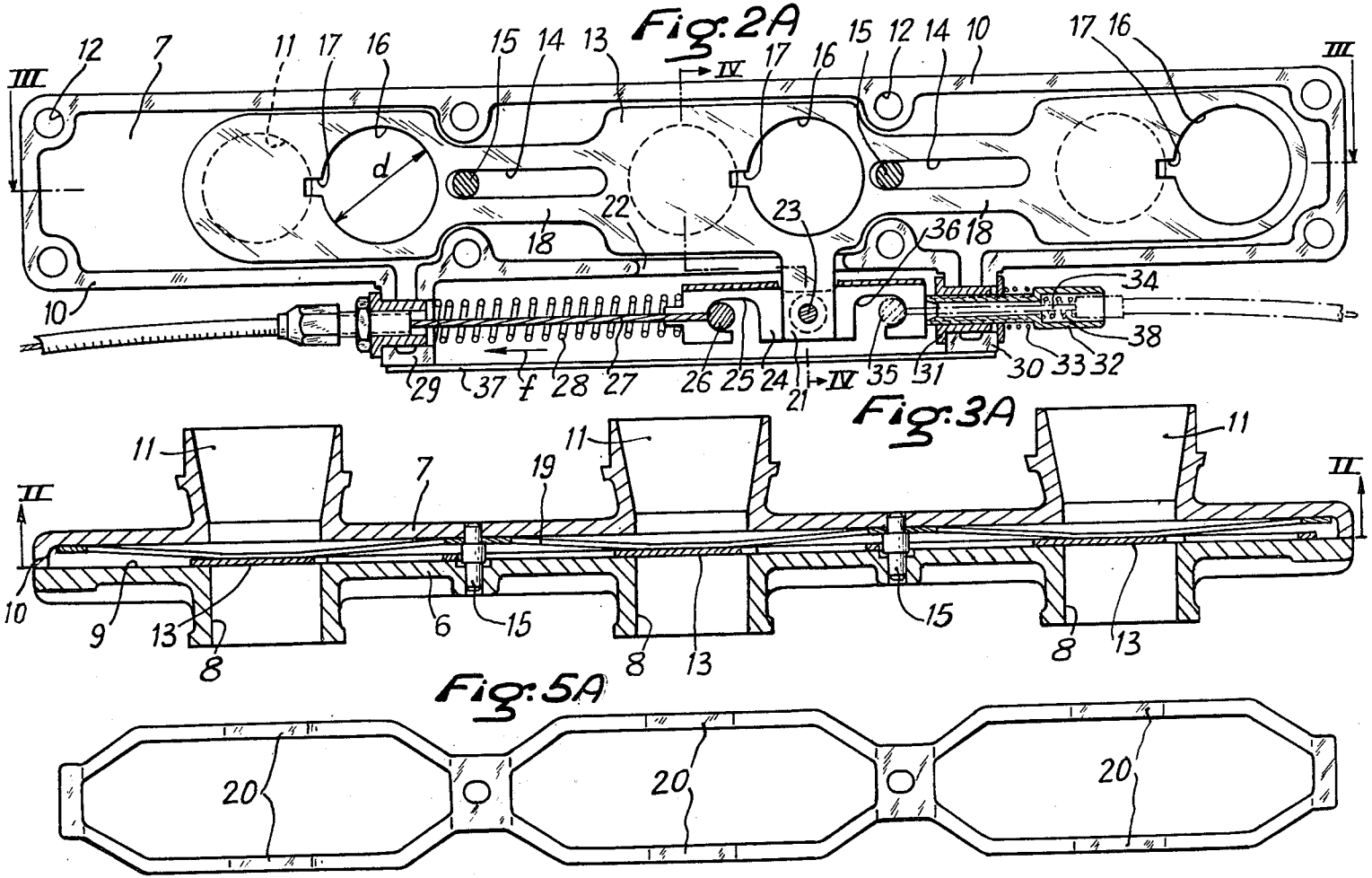
FIG. 2A is a lengthwise cross sectional view taken along the line II—II of FIG. 3 of the control system shown in FIG. 1 with the movable blade in the idle position.
FIG. 3A is a cross sectional view along line III—III of FIG. 2A.
FIG. 5A is an elevational view of a leaf spring which is part of the system of FIGS. 2A and 4.
Figures 2B, 3B, 5B:
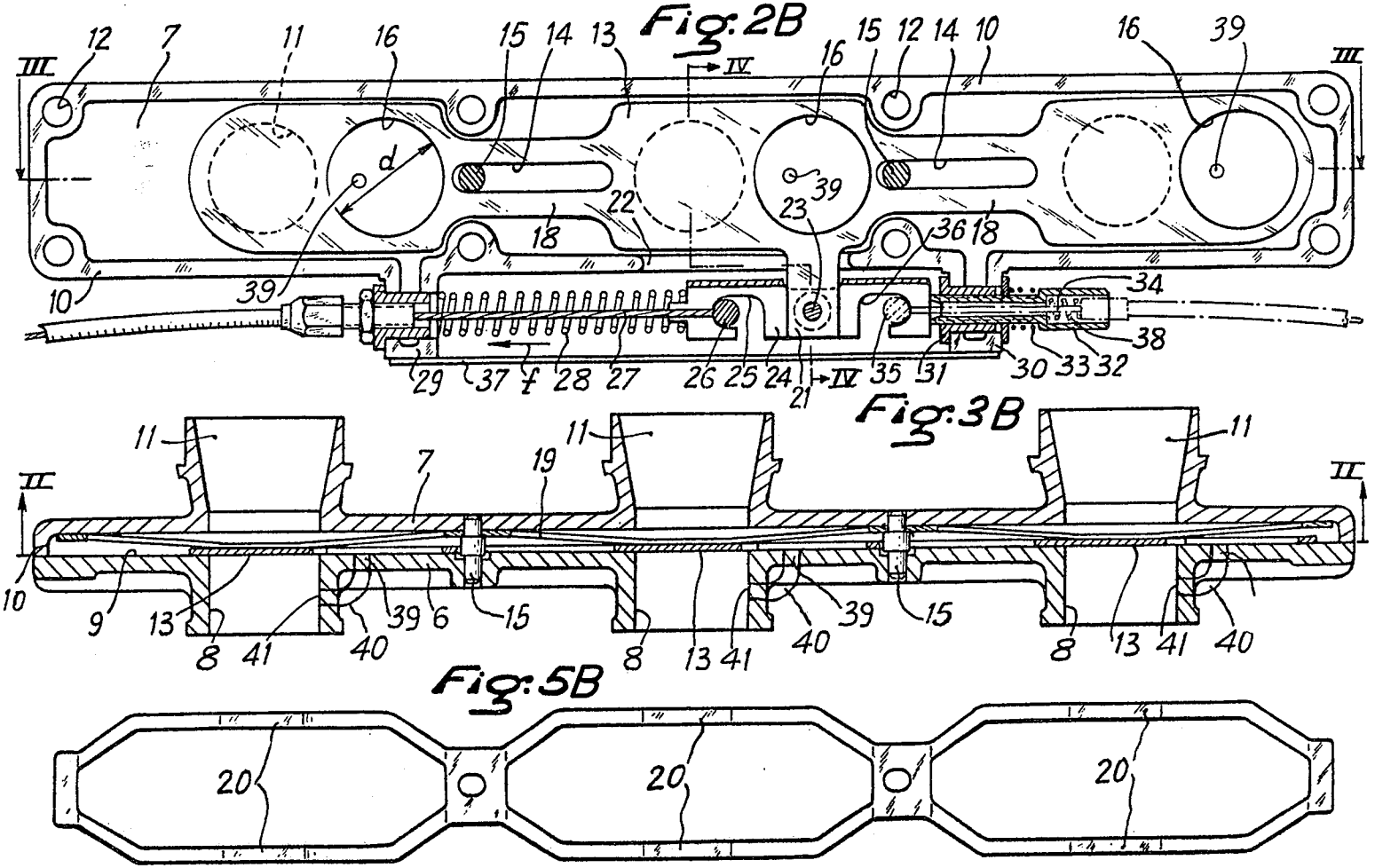
FIG. 2B is a lengthwise cross sectional view of a control system similar to that of FIG. 2A according to a variant of the invention.
FIG. 3B is a cross sectional view along line III—III of FIG. 2B.
FIG. 5B is an elevational view of a leaf spring which is part of the system of FIG. 2B.

System 1 includes a substantially dust-tight casing composed of a plate 6 and a lid 7 (FIGS. 2A and 3A; FIGS. 2B and 3B). Plate 6 has orifices 8 designed to be connected to intakes 4 by pipes 3 in a number equal to the number of cylinders 5. The inside face line of the plate is finished with fairly wide tolerances as to planes, while the rest of the plate can be cast.

Lid 7 has a peripheral flange 10, the face of which is applied to the plate, is finished while the rest of the lid can also be cast. The lid has orifices 11 disposed opposite orifices 8 of the plate and designed to be connected to the silencers and air filter assembly 2. Plate 6 and lid 7 are attached to each other by bolts (not shown) which, for example, pass through holes 12.

Inside this casing is disposed a movable throttle plate constituted by flexible blade 13 which is mounted such as to be translationally displaceable in a parallel plane to the inside face 9 of plate 6. In the case where intake pipes 3 are arranged in a line, as shown in FIG. 1, the translational movement of blade 13 is rectilinear but it is understood that the invention can equally well apply to other arrangements by providing a curvilinear translational movement of blade 13.

Blade 13 has openings 14 which are straight-edged in the embodiment shown. In these openings are engaged guide pins 15 supported by the plate and the lid.

Apertures 16 corresponding to the same number as the orifices of the plate and of the lid and having the same spacing as the orifices, are constructed in blade 13. These apertures have a generally circular principal part of diameter $d$ which is less than half the distance between the centers of two adjacent orifices. In addition, each aperture according to the first variant of the present invention is extended by a slot 17 (FIG. 2A) of small cross sectional area disposed along the axis of the blade 13, the function of which will be explained subsequently.

It will be noted that the portions of blade 13 in which apertures 16 are made of a length slightly greater than (2) ($d$). These portions are separated by shorter portions 18 in which openings 14 are made in order to increase the flexibility of blade 13, in the direction perpendicular to the plane of FIG. 2A and FIG. 2B. The face of blade 13 which is applied to plate 6 is polished and can advantageously be covered with an anti-friction coating to reduce friction between the plate and the blade.

Between blade 13 and lid 7 is arranged a leaf spring 19 (FIG. 3A and 5A; FIGS. 3B and 5B) of undulated shape which can bear both on lid 7 and on blade 13 to apply the latter to plate 6. It will be seen from FIG. 5A and 5B that spring 19 is recessed such that its bearing zones 20 on blade 13 are situated on both sides of apertures 16 of the blade, in the vicinity of the edges of the latter, such as to maintain a free space in the zone swept by the apertures when the blade moves.

Figure 4:
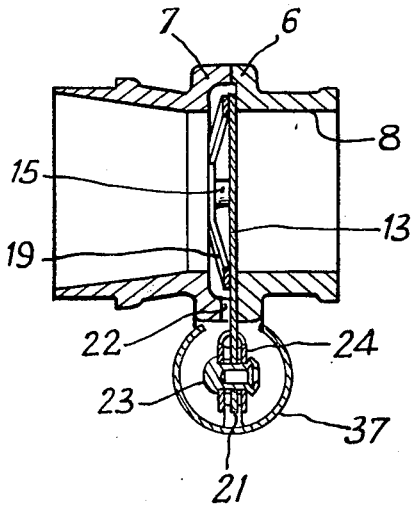
FIG. 4 is a transverse cross sectional view along line IV—IV of FIG. 2A.

At its median part, movable blade 13 has an actuating tab 21 which projects outside the casing through a slot 22 made in the flange of lid 7 (FIGS. 2A, 2B and 4). This tab is fixed by a rivet 23 to a slide 24 which has two half-shells, gripping tab 21 between them. Slide 24 has a slot 25 in which is engaged a lead button 26 at the end of a control cable 27. A return coil spring 28 disposed coaxially to cable 27 bears on one side on slide 24 and on the other side on a boss 29 of lid 7. The assembly of these control elements is protected by a hood 37.

Another boss 30 is arranged on the other side of slide 24 with respect to boss 29 and has a tapped sheath 31 in which is engaged an idle adjustment screw 32 fitted with a return spring 33. The end of this screw serves as an adjustable stop for slide 24 at one end of its stroke.

Screw 32 can, as shown in FIG. 2A and in FIG. 2B, be hollow to allow for passage of a second control cable 34 shown in dots and dashes which is attached to slide 24 by a lead button 35 engaged in a second slot 36. In the case of control which is positive in both directions, a return spring 38 acts on this second cable.

FIGS. 2A and 3A represent movable blade 13 in the idle position in which slide 24 bears on the end of screw 32. In this position, most of the orifices 8 of the plate are blocked by blade 13 except for a small portion which is opposite slot 17 (FIG. 2A). By turning screw 32 on can vary the surface of the parts so cleared and it will be understood that the small cross sectional area of slots 17 permits fine adjustment of this surface and thus allows the deceleration of the speed of the engine.

The thickness of movable blade 13 and the mechanical characteristics of the material composing it are chosen such that the blade perfectly matches the shape of face of plate 6 on which it is applied by the action of spring 19 and such that it does not collapse when subjected to the forces due to the low pressure prevailing in engine intake manifold 3. It will be understood, under these conditions, that outside slots 17, (FIG. 2A) blade 13 and face 9 of the plate form an airtight connection even if the plate has become slightly bent during assembly or operation. It will also be understood that to obtain this tightness it is not necessary to impose very narrow tolerances as to the planeness of face 9 of the plate. This is due to the fact that the blade acted upon in the direction of this face of the plate by spring 19 is applied against this face by the differential pressure existing between its two sides in the same manner as a valve flap is applied to its seat. It is this action of differential pressure distributed over the entire surface of the blade which, combined with its flexibility, compels the blade to match the shape of face 9 of the plate, and thus enables perfect tightness to be made with a low plate-machining cost.

When cable 27 and/or secondary control cable 34 is acted upon to increase the engine speed, slide 24 moves in the direction of arrow $f$ by compressing spring 28. Apertures 16 are progressively superimposed on orifices 8 and 11 of the plate and lid, thus increasing the air passage cross section.

It will be noted that the forces acting on the cables and on return spring 28 are co-linear and are situated in the plane of blade 13. Accordingly, the latter is subjected to no flexional torque when moving, which would tend to deform it or separate it from the base of the plate. The resultant of these forces acting on the blade can advantageously be reduced by anti-friction coating of the movable blade.

Instead of providing slots 17 (FIG. 2A) for idling the engine, one may, according to the second variant shown in FIGS. 2B, 3B and 5B, pierce in plate 6, channels 39 which emerge opposite apertures 16 of the movable blade when the latter is in idle position. These channels in the second variant are connected outside the casing by ducts 40 to other channels 41 pierced in the wall of orifices 8 of the blade. This enables the idle to be adjusted independently for each cylinder.

Figure 6:
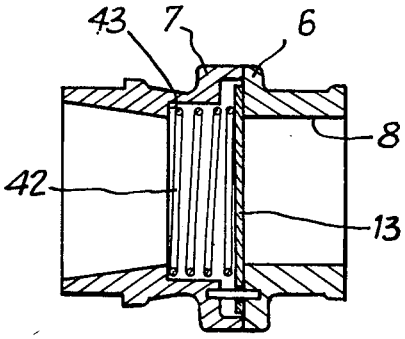
FIG. 6 is a view similar to that of FIG. 4 showing an alternative embodiment.

FIG. 6 shows an alternative embodiment in which the single-leaf spring 19 is replaced by a series of coil springs 42 which, in the region of each of orifices 8 of the plate, applies movable blade 13 to plate 6, bearing on shoulder 43 of lid 7.

The invention is, of course, not limited to the embodiment described hereinabove and many variations of design available to the engineer may be made thereto without departing from the scope of the invention. Thus, displacement of the movable blade is not necessarily a translational displacement provided that the blade moves parallel to the plate.

What is claimed is:

1. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifices of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade; and elastic components abutting said blade for applying the solid portions of said blade in a gas-tight manner to the solid portions of said plate, and wherein the thickness of the blade and the mechanical characteristics of the material composing it are chosen such that the blade, when acted upon by said elastic components, flexes and matches the shape of the plate surface to which it is applied, and also withstands the force due to the low pressure prevailing in the intake manifold during operation.

2. The throttle according to claim 1, wherein the movable blade is mounted in a substantially dust-tight box, one of whose sides is the plate.

3. The throttle according to claim 1, wherein the guide means of the movable blade include pins attached to the plate and engaging in openings made in the movable blade.

4. The throttle according to claim 1, wherein the control means of the movable blade include manual activating means and elastic return means so that the activating forces and the return forces are co-linear and situated essentially in the plane of the blade such as to prevent any flexional torque on the movable blade.

5. The throttle according to claim 1, wherein the face of the movable blade which is applied to the plate has an anti-friction coating.

6. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifices of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade;

elastic components abutting said blade for applying the solid portions of said blade in a gas-tight manner to the solid portions of said plate, wherein the thickness of the blade and the mechanical characteristics of the material composing it are chosen such that the blade, when acted upon by said elastic components, matches the shape of the plate surface to which it is applied, and also withstands the force due to the low pressure prevailing in the intake manifold during operation; and a substantially dust-tight box, said movable blade being mounted in said substantially dust-tight box, one of whose sides is the plate, and wherein the box includes a lid which has a peripheral flange with a machined face applied to the plate.

7. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifices of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade;

elastic components abutting said blade for applying the solid portions of said blade in a gas-tight manner to the solid portions of said plate, wherein the thickness of the blade and the mechanical characteristics of the material composing it are chosen such that the blade, when acted upon by said elastic components, matches the shape of the plate surface to which it is applied, and also withstands the force due to the low pressure prevailing in the intake manifold during operation; and a substantially dust-tight box, said movable blade being mounted in said substantially dust-tight box, one of whose sides is the plate, and wherein the elastic components include a leaf spring arranged between the movable blade and the wall of the box opposite the plate.

8. The throttle according to claim 7, wherein the leaf spring is perforated such as to rest upon the movable blade in the vicinity of its edges and outside the zone swept by the apertures during displacement of the blade.

9. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifices of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade;

elastic components abutting said blade for applying the solid portions of said blade in a gas-tight manner to the solid portions of said plate, wherein the thickness of the blade and the mechanical characteristics of the material composing it are chosen such that the blade, when acted upon by said elastic components, matches the shape of the plate surface to which it is applied, and also withstands the force due to the low pressure prevailing in the intake manifold during operation; and a substantially dust-tight box, said movable blade being mounted in said substantially dust-tight box, one of whose sides is the plate, and wherein the elastic components includes a series of springs, such as coil springs, resting respectively on the movable blade in the vicinity of each of the orifices of the plate.

10. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifices of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade and wherein the movable blade includes portions of reduced cross sectional area disposed between the portions with apertures to increase its flexibility; and elastic components abutting said blade for applying the solid portions of said blade in a gas-tight manner to the solid portions of said plate.

11. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifices of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade and wherein each of the apertures in the movable blade communicate with a slot of small cross sectional area disposed such as to be opposite an orifice of the plate in the idle position; and elastic components abutting said blade for applying the solid portions of said blade in a gas-tight manner to the solid portions of said plate.

12. A movable throttle for use in an intake control system for an internal combustion engine having an intake manifold and engine cylinders comprising:

a substantially rigid plate having orifices, each orifice connected to the intake of one of said engine cylinders;

a movable blade adjoining said plate, said blade having apertures equal in number to the orifice of said plate, the spacing between said apertures being equal to the spacing between said orifices, said blade having a control and guide means for ensuring that the blade moves parallel to said plate so that said blade may move from a running position in which the apertures of the blade are substantially opposite the orifices of said plate to an idle position in which at least a majority of the orifices of said plate are obturated by the blade;

elastic components abutting said blade for applying the solid portions of said blade in a gas-tight manner to the solid portions of said plate; and branch ducts for idling, said branch ducts for idling causing each of the orifices of the plate to communicate with an aperture of the movable blade when said blade is in the idle position.

13. The throttle according to claim 12, wherein the plate has channels each of which emerges opposite one aperture in the movable blade when the latter is in the idle position, and ducts connect the outsides of each of these channels to the orifice of the plate corresponding to this aperture of the movable blade.

* * * * *